United States Patent [19]

Leskinen

[11] 4,378,196

[45] Mar. 29, 1983

[54] HIGH-PRESSURE CENTRIFUGAL BLOWER

[75] Inventor: Seppo Leskinen, Västerskog, Finland

[73] Assignee: Oy Mercantile A.B., Helsinki, Finland

[21] Appl. No.: 159,857

[22] Filed: Jun. 16, 1980

[30] Foreign Application Priority Data

Jun. 21, 1979 [FI] Finland ..... 791999

[51] Int. Cl.[3] ..... F01D 3/00; F01D 3/04

[52] U.S. Cl. ..... 415/104; 415/106; 415/98

[58] Field of Search ..... 415/98, 106, 104, 126, 415/131, 132, 105, 107, 171, 170 A, 170 R

[56] References Cited

U.S. PATENT DOCUMENTS 1,999,163 4/1935 Allen ..... 415/105

3,123,010 3/1964 Witt et al. ..... 415/106

FOREIGN PATENT DOCUMENTS 644968 1/1979 U.S.S.R. ..... 415/104

*Primary Examiner*—Louis J. Casaregola

*Assistant Examiner*—Jeffrey A. Simenauer

*Attorney, Agent, or Firm*—Dressler, Goldsmith, Shore, Sutker & Milnamow

[57] ABSTRACT

Disclosed is a high-pressure centrifugal blower, which comprises an impeller with a back plate and pressure leveling blades secured to the back side of that back plate. The blades extend from the periphery of the impeller over some distance radially inwards. In order to regulate the pressure control clearance between the blades and the back wall of the blower case, control members have been installed between the blades and the back wall of the case.

3 Claims, 5 Drawing Figures

HIGH-PRESSURE CENTRIFUGAL BLOWER

BACKGROUND OF THE INVENTION

The present invention relates to a high-pressure centrifugal blower having blades fitted to the back plate of its impeller, the blades extending from the periphery of the impeller over some distance radially inwards. When the impeller of the blower rotates, a pressure difference is created in the blower case between its inflow side and its outflow side. This pressure difference produces an axial load on the blower bearings, the magnitude of the load being the area of the blower suction inlet multiplied by the pressure difference between the inlet and the outlet.

In low-pressure blowers this load is not significant, owing to the low pressure, but with increased pressure the significance of this load increases, and in high-pressure blowers the axial load is a factor decisive in dimensioning.

SUMMARY OF THE INVENTION

According to the characteristics of the invention, the axial load is compensated for by installing control members between the blades and the back wall of the case in order to regulate the pressure control clearance between the blades and the back wall of the blower case. If the blades of the impeller are designed appropriately, the axial force can be totally compensated for by the control members. Thereby, the size of the bearings is reduced considerably and the bearing system is simplified.

Pressure leveling blades are known from, for example, pumps which have a small size and are usually manufactured by casting and machining techniques with relatively precise tolerances. In such pumps, satisfactory results can be obtained in pressure leveling by means of blades alone. Instead, in blowers, which have a size about 10–20 times that of pumps and are usually manufactured from relatively thin plate by welding with relatively high tolerances, blades alone do not produce satisfactory results. The low pressure produced by the blades is decisively dependent on the distance (a) of the blade from the back plate of the case. Considering the load of the axial bearing, the distance (b) between the back plate of the impeller and the back plate of the case must be maintained at a minimum. The ratio between these distances is also crucial both for the value of the maximal pressure developing adjacent to the hub and above all for the distribution of low pressure in the radial direction. Namely, the pressure increases exponentially in the direction of the impeller radius, until at the periphery it is the same as the general pressure prevailing in the case. This question is illustrated by the following example:

If the diameter of the impeller is 3000 mm, the corresponding case diameter being usually in the order of about 5000 mm and the case width 1500 mm, in terms of production technology it is not possible, without decisively increasing the cost, to achieve a tolerance less than $\pm 2$ mm in dimension a. In order to ensure sufficient operational clearance, dimension a must be at minimum 4 mm$\pm 2$ mm. In other words, dimension a varies within a range of 2 . . . 6 mm. Owing to the load of the axial bearing, dimension b should not exceed 10 mm, the variation range thus being 8 . . . 12 mm. The ratio of dimension a to dimension b can thus vary within a range of 1:4 . . . 1:2. Variations this great crucially affect both the generating maximal pressure and, above all, the change in pressure in the direction of the impeller radius. Thus, even the order of magnitude of the compensating axial force can vary. Furthermore, in blowers the matter is complicated by the fact that the axial force required even in one and the same blower type can vary, depending on the use.

Such pressure leveling blades with their control members are especially significant in a high-pressure centrifugal blower in which the impeller blades are extended as far as the hub of the impeller and in which that side of the blades facing the suction inlet is aerodynamically designed to correspond to the structure of the impeller. By using such an impeller it is possible to manufacture series of blowers with which a total pressure at least double the total pressure of conventional impellers can be obtained. Pressure leveling blades according to the invention can, of course, also be used in conventional impellers.

BRIEF DESCRIPTION OF THE DRAWINGS

Some embodiments of the invention are illustrated below with reference to the accompanying drawing, but without limiting the invention to these embodiments.

DESCRIPTION OF THE PREFERRED EMBODIMENTS

Figure 1:
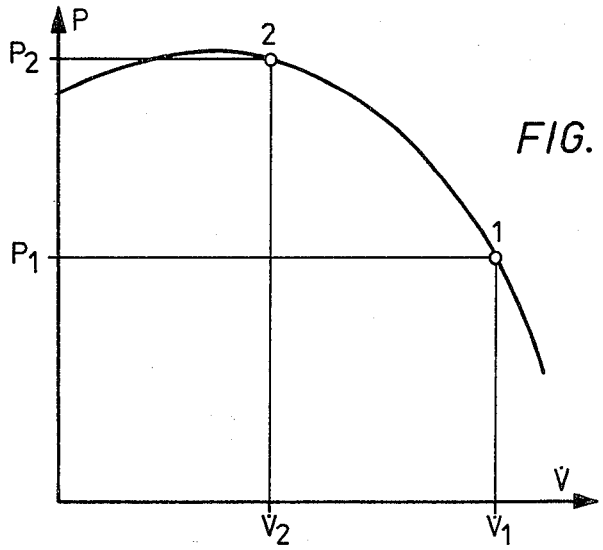
FIG. 1 of the drawing depicts the characteristic curve for the impeller and the variations of its axial force.

FIG. 1 illustrates the fact that, even in one and the same blower type, the axial force can vary, depending on the use. If the blower operates at point 1 of its characteristic curve, the pressure developed by it is $P_1$, and the axial force corresponding to this pressure should be compensated for. Linked to some other plant, the same blower can operate at point 2, the pressure $P_2$ corresponding to this point being nearly twice as great as $P_1$. Thus, even though the blower could otherwise be exactly the same in the two cases, for the compensation of the axial force the blades 1 (FIG. 2) should be designed separately for each use. $V_1$ and $V_2$ are the volumes of air corresponding to pressures $P_1$ and $P_2$.

Figure 2:
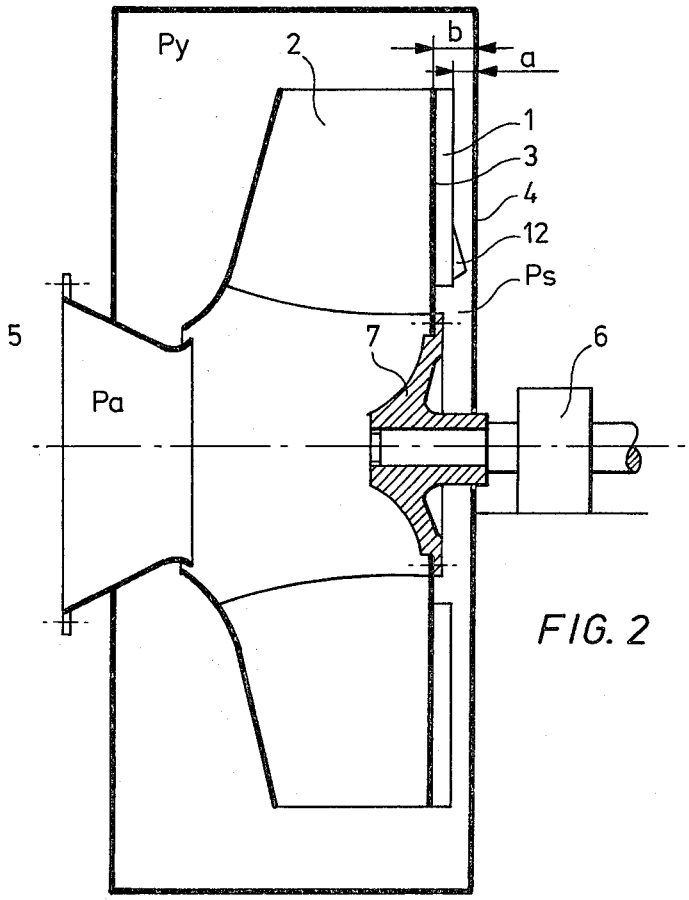
FIG. 2 depicts a total representation of a blower according to the invention.

According to FIG. 2, the blades 1 have been attached to the back plate 3 of the blower impeller 2, in which case a low pressure Ps is formed in the clearance between the back plate of the blower case 4 and the impeller 2. The blades of the impeller 2 can extend as far as the hub 7 of the impeller, and that part of the blades which faces the suction inlet 5 has been designed appropriately in terms of aerodynamics. When the impeller rotates, a high pressure Py is formed on the outflow side of the impeller and a low pressure Pa on its inlet side, i.e. at suction inlet 5. The pressure difference produces an axial force at the bearings 6, the value of the force being the suction inlet 5 area$\times$(Py$-$Pa). By means of the control members 12 (one type is illustrated in greater detail in FIG. 5) according to the invention, the axial force can be totally compensated for, in which case smaller bearings 6 can be used.

Figure 3:
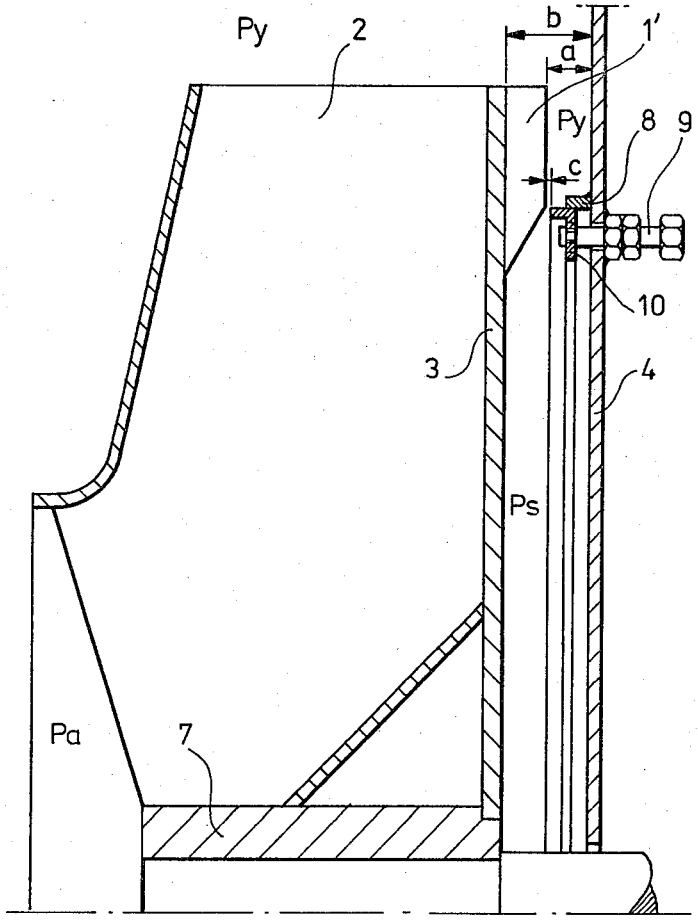
FIGS. 3, 4 and 5 depict three different embodiments of the invention.

A preferred embodiment of the invention is shown in FIG. 3. In it the blade 1' does not extend as far as the hub 7 but ends at a suitable distance from the periphery of the impeller 2. Furthermore, the blade is relatively narrow, in which case the clearance a between the blade 1' and the back plate 4 of the case is extensive, i.e. the ratio of the clearance a to the clearance b between the impeller back plate 3 and the case back plate 4 is less than 1:2. A guide ring 8 has been attached to the back wall 4 of the case, and inside this ring 8 there is a control ring 10 which can be moved by means of control screws 9, the distance c between the control ring 10 and the blade 1' being regulatable. Owing to the extensive clearance a, the pressure prevailing outside the control ring 10 is approximately the same high pressure Py as in the other parts of the case 4. Inside the ring 10 there prevails an approximately constant low pressure Ps, the value of which depends on the clearance c and on the distance of the ring 10 from the axis of the impeller. The clearance c can be adjusted, by means of the screws 9, to a very small value after the assembly of the blower, since most of the manufacturing defects can be eliminated. Such defects include faulty mutual positioning of the case 4 and the impeller 2, defect in the parallellism of the impeller 2 and the case 4, the conical shape of the back plate of the impeller 2 and/or the back plate of the case 4, etc. When the clearance c is made sufficiently small, the pressures Py and Ps can be calculated with sufficient precision and the pressure Ps can be dimensioned to correspond to the maximum pressure $P_2$ of the blower in FIG. 1. The axial force corresponding to pressure $P_1$ in FIG. 1 can be produced by setting the clearance c at a greater value, in which case pressure Ps increases and pressure difference Py-Ps decreases. This can be effected even in situ, if the use of the blower and the operating point on the characteristic curve change later. If an axial-force sensor is installed in the bearing 6 (FIG. 2), the axial force can be set precisely at zero by means of the ring 10.

Figure 4:
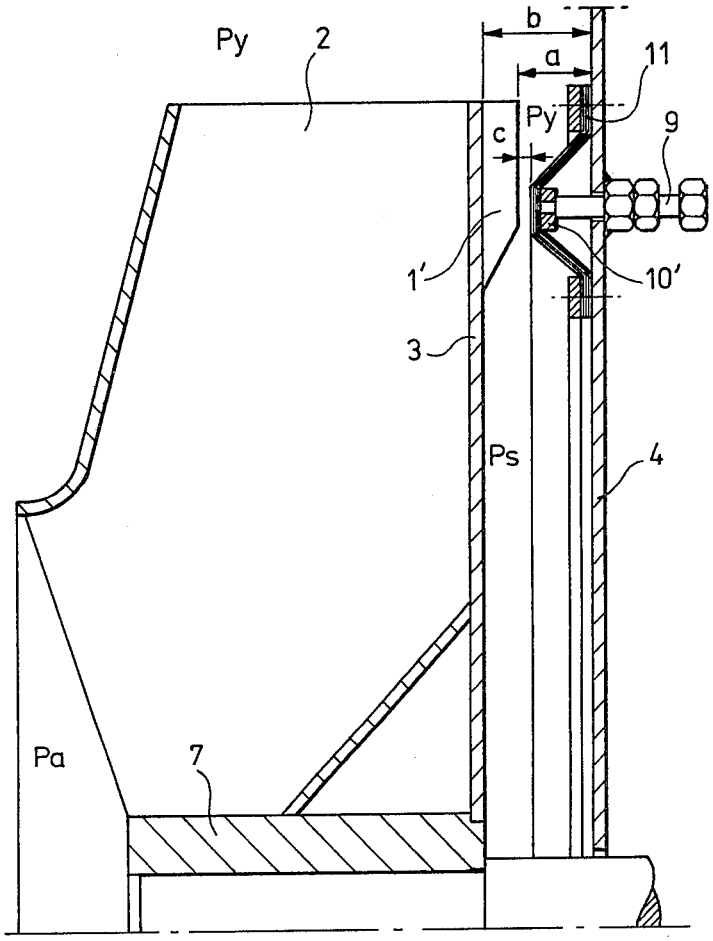

FIG. 4 depicts another preferred embodiment of the invention, in which the control ring 10' is regulated by a diaphragm 11 made from an elastic material.

Figure 5:
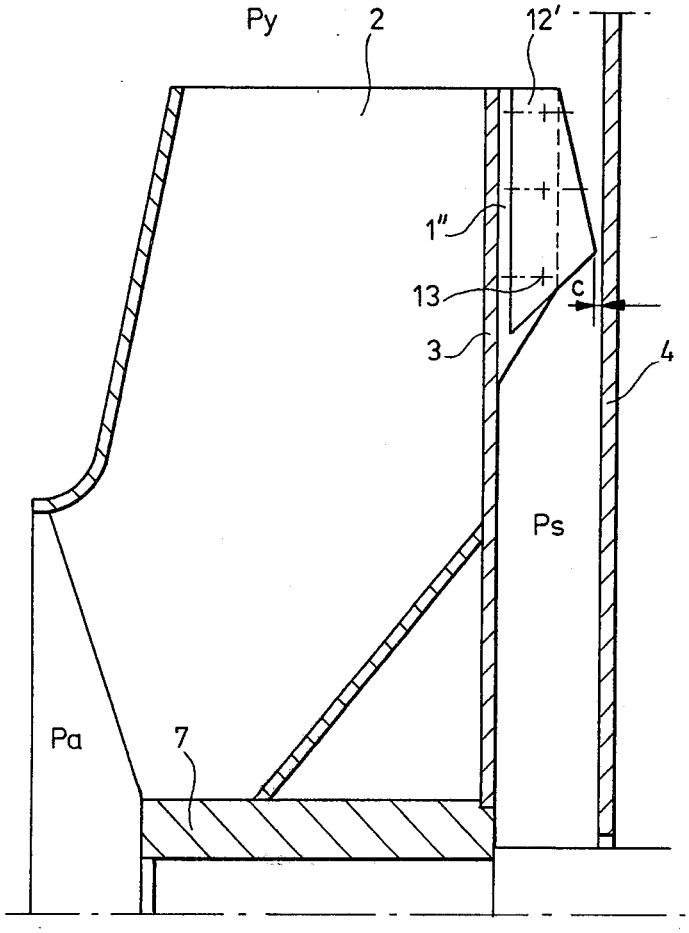

In the embodiment according to FIG. 5, the control takes place by means of control members 12' connected to the blades 1'', these members 12' being attached to the blades 1'' by bolts 13, by means of which the distance between the control members 12' and the back wall 4 of the case can be varied.

What is claimed is:

1. A high-pressure centrifugal blower, including an impeller, a back plate of said impeller, pressure leveling blades secured to the back side of said back plate and extending from the periphery of the impeller over some distance radially inwards, a blower case around said impeller, and control means for regulating the pressure control clearance between said blades and the back wall of said case, said control means comprising control ring means installed on said back wall of said case between said blades and said back wall supported by regulating screw means secured to said back wall of said blower case.

2. A centrifugal blower according to claim 1, wherein said control ring means comprise a control ring in alignment with said blades, said regulating screw means comprising regulating screws secured to said back wall of said blower case supporting said control ring.

3. A centrifugal blower according to claim 1, wherein said control ring means comprise a control ring in alignment with said blade, said regulating screw means comprising regulating screws secured to said back wall of said blower case supporting said control ring, said control means further comprising a diaphragm of elastic material attached to said back wall of said blower case, said control ring being guided by said diaphragm.

* * * * *